US010941928B2

(12) United States Patent
Micunek et al.

(10) Patent No.: US 10,941,928 B2
(45) Date of Patent: Mar. 9, 2021

(54) CARRYING HANDLE FOR AN AUTOMATED MOVING-MIRROR LUMINAIRE

(71) Applicant: Robe Lighting s.r.o., Roznov pod Radhostem (CZ)

(72) Inventors: Tomas Micunek, Roznov pod Radhostem (CZ); Josef Valchar, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 0 days.

(21) Appl. No.: 16/517,348

(22) Filed: Jul. 19, 2019

(65) Prior Publication Data

US 2019/0338933 A1 Nov. 7, 2019

(51) Int. Cl.

| | |
|---|---|
| ***F21V 21/00*** | (2006.01) |
| ***F21V 21/40*** | (2006.01) |
| ***F21V 14/04*** | (2006.01) |
| *F21W 131/10* | (2006.01) |
| *F21W 131/406* | (2006.01) |

(52) U.S. Cl.

CPC ..... *F21V 21/40* (2013.01); *F21V 14/04* (2013.01); *F21W 2131/10* (2013.01); *F21W 2131/406* (2013.01)

(58) Field of Classification Search

CPC ... F21W 2131/406; F21V 14/04; F21V 21/40; G03B 15/06

See application file for complete search history.

(56) References Cited

U.S. PATENT DOCUMENTS

| | | | | |
|---|---|---|---|---|
| 2,909,652 | A * | 10/1959 | Pratt | G03B 15/02 362/294 |
| 4,933,822 | A * | 6/1990 | NakaMats | F21S 6/003 362/282 |
| 5,333,102 | A * | 7/1994 | Oberman | F21V 14/04 362/272 |
| 5,384,694 | A * | 1/1995 | Yang | F21V 9/08 362/298 |
| 5,590,955 | A * | 1/1997 | Bornhorst | F21S 10/06 362/324 |
| D439,692 | S * | 3/2001 | Kung | D26/68 |
| 6,461,021 | B1 * | 10/2002 | Warnecke | F21V 17/02 362/272 |
| 7,052,160 | B1 * | 5/2006 | Chang | F21V 7/0008 359/877 |
| 7,789,543 | B2 | 9/2010 | Manscher | |
| D638,573 | S | 5/2011 | Toft | |
| 8,408,760 | B2 | 4/2013 | Bornhorst et al. | |
| 2003/0137834 | A1 * | 7/2003 | Jigamian | F21L 4/00 362/205 |
| 2003/0137842 | A1 * | 7/2003 | Chang | F21S 10/06 362/284 |
| 2006/0109574 | A1 * | 5/2006 | Chang | F21V 7/0008 359/877 |

(Continued)

*Primary Examiner* — Julie A Bannan

(74) *Attorney, Agent, or Firm* — Conley Rose, P.C.; Grant Rodolph; Brooks W Taylor

(57) ABSTRACT

A luminaire includes a mirror, a housing, and a carrying handle. The mirror is configured to controllably deflect a light beam emitted from the luminaire. The housing has a mirror end at which the mirror is located. The carrying handle is located at the mirror end of the housing and is configured to cause the luminaire to hang substantially vertically when supported by the carrying handle.

9 Claims, 3 Drawing Sheets

(56) References Cited

U.S. PATENT DOCUMENTS

| | | | | |
|---|---|---|---|---|
| 2010/0008080 | A1* | 1/2010 | Vinther | F21V 21/30<br>362/190 |
| 2011/0164428 | A1* | 7/2011 | Brutsche | F21V 21/15<br>362/427 |
| 2015/0145994 | A1* | 5/2015 | Quadri | F21V 21/30<br>348/144 |
| 2016/0305644 | A1* | 10/2016 | Quadri | F21V 21/22 |

* cited by examiner

CARRYING HANDLE FOR AN AUTOMATED MOVING-MIRROR LUMINAIRE

TECHNICAL FIELD OF THE DISCLOSURE

The disclosure generally relates to automated luminaires, and more specifically to a carrying handle for an automated moving-mirror luminaire.

BACKGROUND

Luminaires with automated and remotely controllable functionality (referred to as automated luminaires) are well known in the entertainment and architectural lighting markets. Such products are commonly used in theatres, television studios, concerts, theme parks, night clubs, and other venues. A typical product will provide control over pan and tilt functions of the luminaire, allowing an operator to control a direction the luminaire is pointing and thus a position of its light beam on a stage or in a studio. This position control is typically performed using one of two alternative systems. In one system, by mounting the luminaire head in a yoke that allows control of the head's position in two orthogonal rotational axes (referred to as a moving-yoke luminaire). In another system, by directing a light beam from a stationary luminaire via a mirror that can be tilted and rotated to controllably deflect the light beam (referred to as a moving-mirror luminaire). Automated luminaires are often installed for a first show and then relocated and installed again for a second show. Thus, it is desirable to improve convenience in installing, moving, hand-carrying, and transporting automated luminaires from show to show—or venue to venue.

Automated moving-mirror luminaires can be awkward to transport or hand-carry. The mirror is fragile and needs to be protected while the luminaire is being moved or otherwise handled, but such protection should not interfere with mirror motion while the luminaire is in use. Additionally, the center of gravity of a moving-mirror luminaire is typically towards the rear of the luminaire, away from the mirror.

Some moving-mirror luminaire carrying handles have been located on a rear or lateral side of the luminaire, which causes unsteady handling relative to the center of gravity. Further, such carrying handle positioning precludes setting the fixture down vertically on the floor on rear-mounted feet. For other moving-mirror luminaires, a suspension yoke of the luminaire may be used as a grip for handling. However, suspension yokes are often sharp edged, positioned in an unknown relationship to the center of gravity, and the yoke pivot point may not be secured to the luminaire housing, causing the luminaire to swing unexpectedly when lifted by the yoke.

SUMMARY

A luminaire includes a mirror, a housing, and a carrying handle. The mirror is configured to controllably deflect a light beam emitted from the luminaire. The housing has a mirror end at which the mirror is located. The carrying handle is located at the mirror end of the housing and is configured to cause the luminaire to hang substantially vertically when supported by the carrying handle.

BRIEF DESCRIPTION OF THE DRAWINGS

For a more complete understanding of this disclosure, reference is now made to the following brief description, taken in conjunction with the accompanying drawings in which like reference numerals indicate like features.

DETAILED DESCRIPTION

Preferred embodiments are illustrated in the figures, like numerals being used to refer to like and corresponding parts of the various drawings.

The disclosure generally relates to a carrying handle for an automated moving-mirror luminaire. The handle is located on a side of the luminaire at the end adjacent to the mirror, away from the center of gravity. Such positioning provides a stable carrying position with the luminaire hanging almost vertically from the handle with its center of gravity below the handle. The handle's location also facilitates both removal from and insertion into a road case, as well as setting the fixture on the ground on rear mounted feet. The handle provides a safe and comfortable handling position, in contrast to carrying the luminaire by its suspension yoke.

The handle may alternately be situated on the end of the luminaire at the end adjacent to the mirror. Such positioning provides a stable carrying position with the luminaire hanging vertically, and also facilitates both removal from and insertion into a road case, as well as setting the fixture on the ground on rear mounted feet. Either handle provides a safe and comfortable handling position such that a unit can be safely held and carried in one hand.

Figure 1:
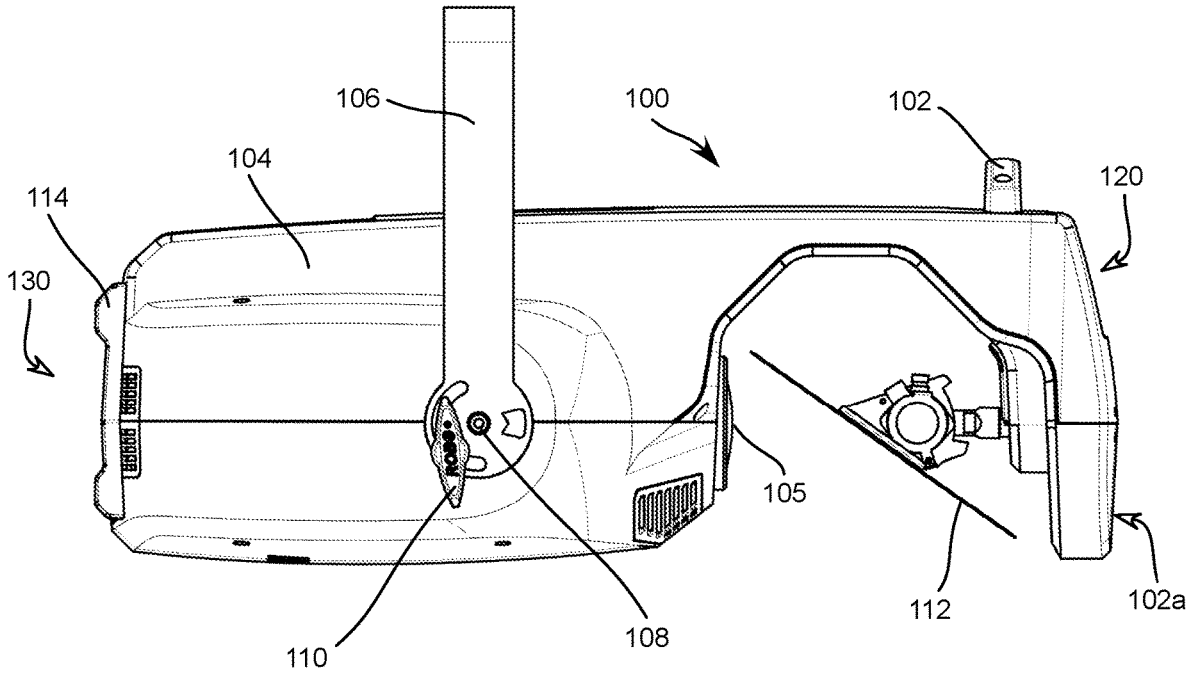
FIG. 1 presents a side view of an automated moving-mirror luminaire according to the disclosure.

FIG. 1 presents a side view of an automated moving-mirror luminaire 100 according to the disclosure. The luminaire 100 comprises a housing 104 that, when installed, is supported by a suspension yoke 106 that pivots around a pivot point 108 and is clamped into position through a locking knob 110. A center of gravity of the luminaire 100 is close to the rotational axis of the pivot point 108. A light beam from an internal light source (not shown) is emitted from the housing 104 through a lens 105 and impinges on a mirror 112 located at a mirror end of the housing 104. Using the mirror 112, the light beam is controllably deflected to position the light beam as desired by a user. The housing 104 further includes a foot 114 located on a foot end face 130 of the housing 104 at a foot end of the housing 104. The foot 114 allows the luminaire 100 to rest stably on the floor in a vertical orientation, i.e., with the mirror end of the housing 104 upwards.

In some embodiments, the foot 114 is a single foot, shaped for example in a partial or complete loop to provide a stable base on which the luminaire 100 rests. In other embodiments, the foot 114 is a plurality of individual feet elements that provide the stable base. The foot 114 shown in FIG. 1 is one of two linear foot elements, the view of the second foot element being occluded by the visible foot element indicated by reference character 114.

A carrying handle 102 is positioned on a side of the housing 104, close to a mirror end face 120 of the housing 104 (which is opposite the foot end face 130 of the housing 104), such that the carrying handle 102 is distant from the pivot point 108 and the center of gravity. The carrying handle 102 is located on a side of the luminaire 100 opposite the opening ("mirror opening") through which the mirror 112 reflects light from the luminaire 100. A carrying handle 102*a* is provided in another embodiment according to the disclosure. The carrying handle 102*a* is shown and described with reference to FIG. 2.

When the user lifts the luminaire 100 by carrying handle 102, the user is aware that the center of gravity is near the pivot point 108 and expects the luminaire 100 to pivot (as needed) around the carrying handle 102 to hang substantially vertically with the center of gravity below the carrying handle 102. Because the luminaire 100 is hanging substantially vertically, the luminaire 100 may be carried in a comfortable and stable way at the user's side. When the luminaire 100 is lowered to the floor, the feet 114 contact the floor and the luminaire rotates (as needed) to rest vertically in a stable way on the feet 114. Furthermore, using the carrying handle 102, the user may carry one automated moving-mirror luminaire 100 in each hand in a comfortable manner.

Figure 2:
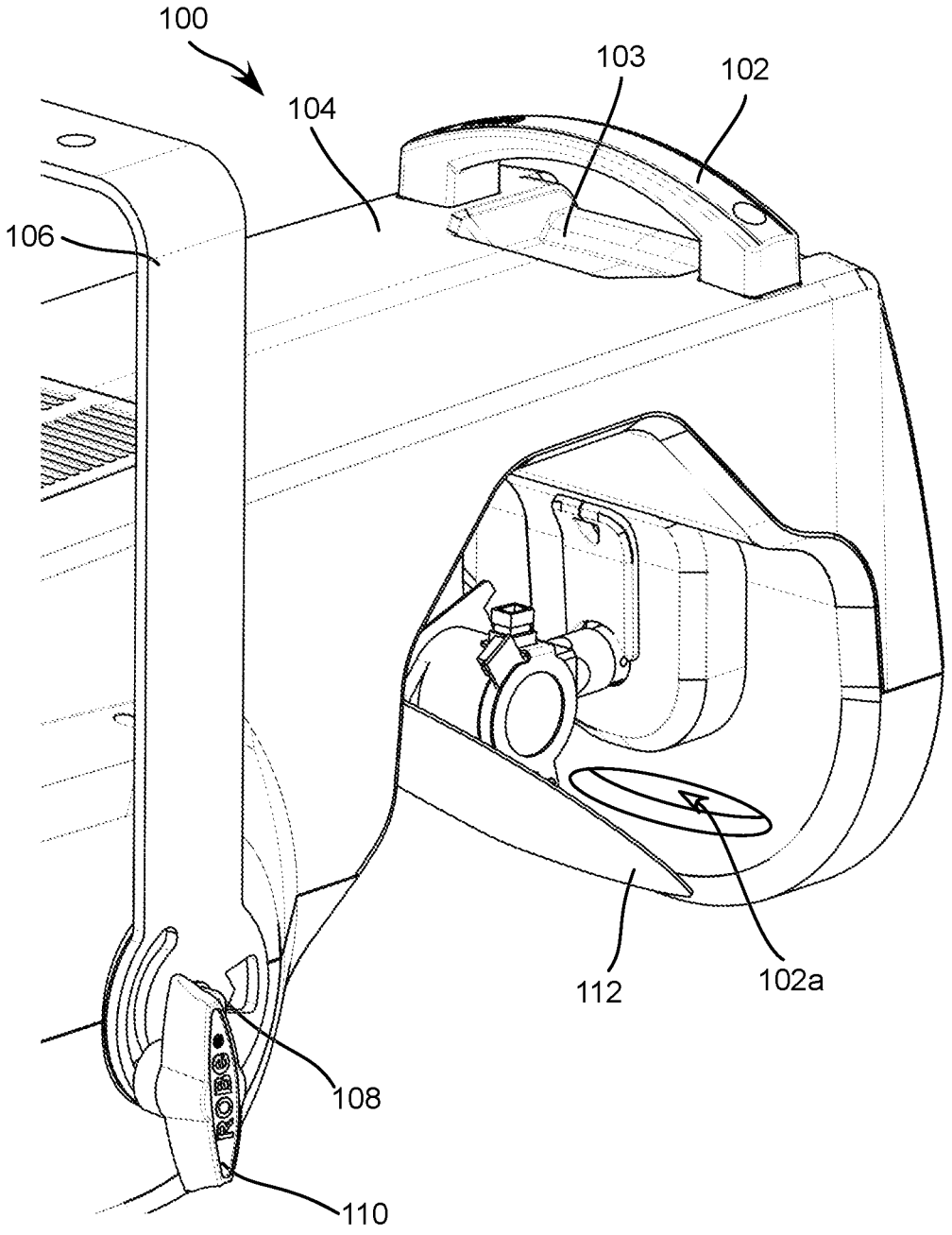
FIG. 2 presents an orthogonal detail view of a portion of the automated moving-mirror luminaire shown in FIG. 1.

FIG. 2 presents an orthogonal detail view of a portion of the automated moving-mirror luminaire 100 shown in FIG. 1. Further visible in this figure is a recess 103 in the housing 104 under or adjacent to the carrying handle 102. The recess 103 is configured to reduce contact between the user's fingers and hand and the housing 104 when the user is grasping the carrying handle 102 in either the vertical and horizontal orientation. Contact between the user's fingers and hand and the housing 104 is reduced relative to contact experienced when grasping the carrying handle 102 of a luminaire 100 without a recess 103. The recess 103 is optional, however, because in other embodiments, the carrying handle 102 arcs father from the side of the housing 104 than is shown in FIGS. 1 and 2. The greater arc of the carrying handle 102 in such embodiments reduces contact between the user's fingers and hand and the housing 104 without the use of a recess such as the recess 103.

In another embodiment according to the disclosure, an aperture is formed in the mirror end face 120 of the housing 104 to create a carrying handle 102*a*. As with the carrying handle 102, when the user lifts the luminaire 100 by carrying handle 102*a*, the luminaire 100 pivots (as needed) around the carrying handle 102*a* and hangs substantially vertically. The luminaire 100 may then be carried in a comfortable and stable way at the user's side. The luminaire 100 may be lowered to the floor, to rest vertically in a stable way on the feet 114. And, the user may carry one automated moving-mirror luminaire in each hand in a comfortable manner using the carrying handle 102*a*.

Figure 3:
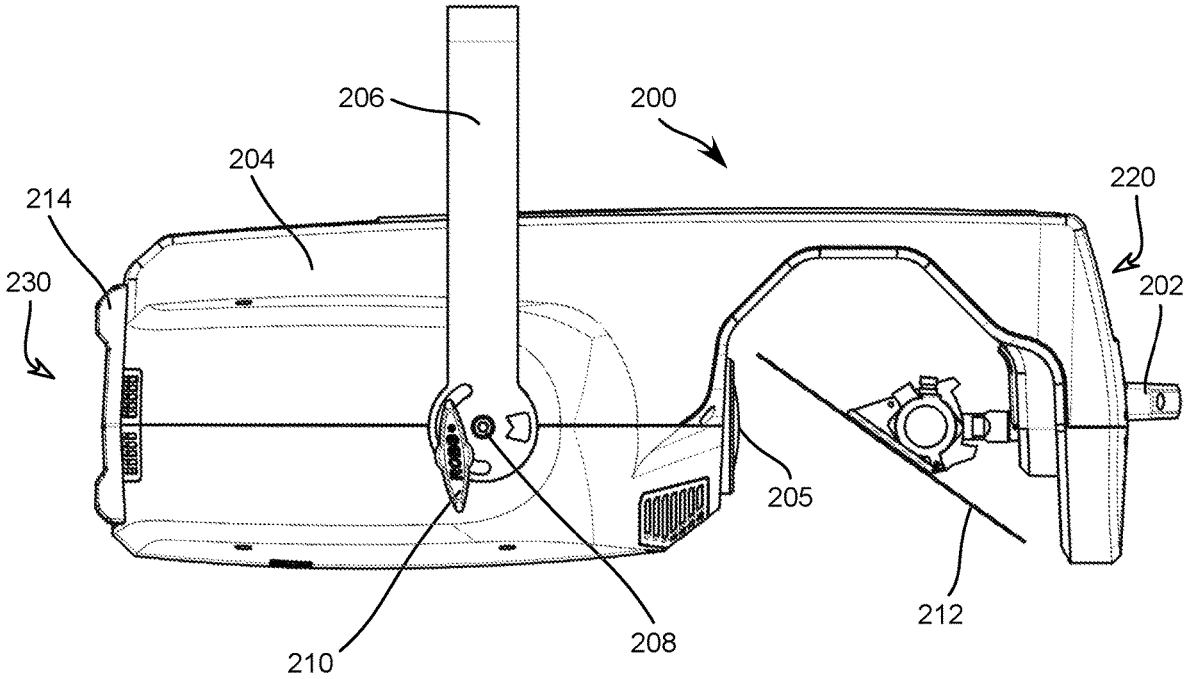
FIG. 3 presents a side view of a second automated moving-mirror luminaire according to the disclosure.

FIG. 3 presents a side view of a second automated moving-mirror luminaire 200 according to the disclosure. Luminaire 200 comprises a housing 204 that, when installed, is supported by a suspension yoke 206, which rotates around a pivot point 208 and is clamped into position using a locking knob 210. A center of gravity of the luminaire 200 is close to the rotational axis of the pivot point 208. Light from an internal light source (not shown) exits the housing 204 through a lens 205 and impinges on mirror 212, from whence it is controllably deflected to position the light beam as desired by the user. The automated moving-mirror luminaire 200 further includes feet 214 located on a foot end face 230 of the housing 204 at a foot end of the housing 204. The feet 214 allow the luminaire to be set on the ground vertically, with the mirror 212 upwards. A carrying handle 202 is positioned on a mirror end face 220 of the housing 204 at the mirror end of the housing 204 and opposite the foot end face 230 of the housing 204, such that the carrying handle 202 is distant from the pivot point 208 and the center of gravity.

The carrying handle 202 is oriented transversely to the opening through which the mirror 212 reflects light. The carrying handle 202 is configured to cause the luminaire 200 to hang vertically when carried. In other embodiments, the carrying handle 202 may be offset from the center of gravity and the luminaire 200 carried substantially vertically, as described with reference to carrying handles 102 and 102*a*, shown in FIGS. 1 and 2.

In some embodiments, a recess (similar to the recess 103 described with reference to FIG. 2) may be provided under the carrying handle 202.

When the user lifts the luminaire 200 by the carrying handle 202, the user expects the luminaire 200 to hang vertically from the carrying handle 202. Because the luminaire 200 is hanging vertically, the luminaire 200 may be carried in a comfortable and stable way at the user's side, and may easily be set onto the floor vertically, resting in a stable way on the feet 214. The carrying handle 202 is configured to allow a user to carry one automated moving-mirror luminaire in each hand in a comfortable manner.

For purposes of this disclosure, the term "substantially vertically" is defined as within +/−30° of vertical with the mirror end of the luminaire at the top and the foot end of the luminaire at the bottom. A handle of an automated moving-mirror luminaire according to the disclosure is defined as "at" or "near" the mirror end of the housing of the luminaire when the handle is configured to cause the luminaire to hang substantially vertically when supported by the handle.

While the disclosure has been described with respect to a limited number of embodiments, those skilled in the art, having benefit of this disclosure, will appreciate that other embodiments may be devised which do not depart from the scope of the disclosure herein. While the disclosure has been described in detail, it should be understood that various changes, substitutions and alterations can be made hereto without departing from the spirit and scope of the disclosure.

What is claimed is:

1. A luminaire comprising:

a light source emitting a light beam;

a mirror optically coupled to the light source and configured to tilt and rotate under remote control to controllably deflect the light beam;

a housing having a mirror end face, the mirror end face extending across an axis of the light beam, the mirror located between the light source and the mirror end face, the mirror end face extending across all of a non-reflective side of the mirror, the mirror mounted to the mirror end face and configured for pan and tilt motion relative to the mirror end face; and a carrying handle fixedly coupled to the housing and located adjacent to the mirror end face of the housing, the carrying handle configured to cause the housing to hang substantially vertically when supported by the carrying handle with the mirror end face at a top end of the hanging housing, wherein the housing includes a recess located adjacent to the carrying handle, the recess configured to reduce contact between a user's fingers and hand and the housing when the user is grasping the carrying handle.

2. The luminaire of claim 1, wherein the carrying handle is located on a side of the housing.

3. The luminaire of claim 1, wherein the carrying handle is located on the mirror end face of the housing.

4. The luminaire of claim 3, wherein the carrying handle is configured to cause the luminaire to hang vertically when supported by the carrying handle.

5. The luminaire of claim 1, wherein the housing comprises a foot located on a foot end face of the housing, the foot end face located on a side of the housing opposite the mirror end face, the foot configured to provide a stable base on which the luminaire rests in a vertical orientation when placed on a floor.

6. The luminaire of claim 5, wherein the foot comprises a plurality of individual foot elements.

7. A luminaire comprising:

a light source emitting a light beam;

a mirror optically coupled to the light source and configured to tilt and rotate under remote control to controllably deflect the light beam;

a housing having a mirror end face, the mirror end face extending across an axis of the light beam, the mirror located between the light source and the mirror end face, the mirror end face extending across all of a non-reflective side of the mirror, the mirror mounted to the mirror end face and configured for pan and tilt motion relative to the mirror end face; and a carrying handle comprising an aperture formed in the mirror end face of the housing, the aperture configured to receive a user's fingers while grasping the carrying handle, the carrying handle configured to cause the housing to hang substantially vertically when supported by the carrying handle with the mirror end face at a top end of the hanging housing.

8. The luminaire of claim 7, wherein the housing comprises a foot located on a foot end face of the housing, the foot end face located on a side of the housing opposite the mirror end face, the foot configured to provide a stable base on which the luminaire rests in a vertical orientation when placed on a floor.

9. The luminaire of claim 8, wherein the foot comprises a plurality of individual foot elements.

* * * * *